US006120385A

United States Patent [19]

Nemeckay

[11] Patent Number: 6,120,385

[45] Date of Patent: Sep. 19, 2000

[54] GOLF TRAINING DEVICE

[76] Inventor: Stephen A. Nemeckay, 11060 Peerless, Detroit, Mich. 48224

[21] Appl. No.: 08/941,415

[22] Filed: Sep. 30, 1997

Related U.S. Application Data

[60] Continuation-in-part of application No. 08/685,441, Jul. 23, 1996, which is a division of application No. 08/312,816, Sep. 27, 1994, Pat. No. 5,538,299.

[51] Int. Cl.[7] ..... A63B 69/36

[52] U.S. Cl. ..... 473/256; 482/109

[58] Field of Search ..... 473/256; 292/305; 482/109

[56] References Cited

U.S. PATENT DOCUMENTS

| | | | |
|---|---|---|---|
| D. 296,866 | 7/1988 | Behring . | |
| 714,605 | 11/1902 | Potter . | |
| 727,707 | 5/1903 | Stauffer et al. . | |
| 772,634 | 10/1904 | Snyder . | |
| 860,369 | 7/1907 | Grundy . | |
| 918,078 | 4/1909 | McCaffrey . | |
| 926,426 | 6/1909 | Koch et al. . | |
| 1,151,131 | 8/1915 | Starliper . | |
| 1,661,868 | 3/1928 | Armstrong et al. . | |
| 2,191,444 | 2/1940 | Fleming . | |
| 2,671,355 | 3/1954 | Hawkins . | |
| 2,732,920 | 1/1956 | Newton . | |
| 2,806,722 | 9/1957 | Atkins . | |
| 2,814,067 | 11/1957 | Bowden . | |
| 2,842,387 | 7/1958 | Della-Porta . | |
| 3,023,036 | 2/1962 | Taylor . | |
| 3,033,599 | 5/1962 | Hudson et al. . | |
| 3,162,084 | 12/1964 | Wurzel . | |
| 3,324,613 | 6/1967 | Duboff . | |
| 3,566,435 | 3/1971 | Nakamura . | |
| 3,834,697 | 9/1974 | McNamara et al. | 473/256 |
| 3,955,828 | 5/1976 | Boudreau . | |
| 4,415,194 | 11/1983 | Bauer . | |
| 4,557,470 | 12/1985 | Link . | |
| 4,602,788 | 7/1986 | Wendt | 473/256 X |
| 4,709,949 | 12/1987 | Umezawa et al. . | |
| 4,723,765 | 2/1988 | Pearson . | |
| 4,777,698 | 10/1988 | Lord . | |
| 4,815,163 | 3/1989 | Simmons . | |
| 4,824,082 | 4/1989 | Schaupp . | |
| 4,865,169 | 9/1989 | Rachels et al. . | |
| 4,915,538 | 4/1990 | Golden et al. . | |
| 4,925,230 | 5/1990 | Shelton . | |
| 5,000,640 | 3/1991 | Haas, Jr. . | |
| 5,024,303 | 6/1991 | Kosloff . | |
| 5,090,089 | 2/1992 | Schulte et al. . | |
| 5,104,161 | 4/1992 | Kautt . | |
| 5,331,718 | 7/1994 | Gilbert et al. . | |
| 5,335,396 | 8/1994 | Dolan . | |
| 5,538,299 | 7/1996 | Nemeckay | 292/305 |
| 5,586,832 | 12/1996 | Zylka . | |

FOREIGN PATENT DOCUMENTS

| | | |
|---|---|---|
| 1425116 | 9/1988 | U.S.S.R. . |
| 821802 | 10/1959 | United Kingdom . |
| 2139282 | 11/1984 | United Kingdom . |

*Primary Examiner*—George J. Marlo

[57] ABSTRACT

A golf training device for aiding in golf swing training and golf warm-up activities. The golf training device includes a golf club-like shaft, an at least one weighted member, and a stopper. The at least one weighted member is adapted to removably mount onto the shaft, and is defined by two temporary lockable interdigitating members and a locking member. The stopper, which attaches to the bottom end of the shaft, further aids in preventing the at least one weighted member from inadvertent disengagement from the shaft.

8 Claims, 2 Drawing Sheets

FIG 1
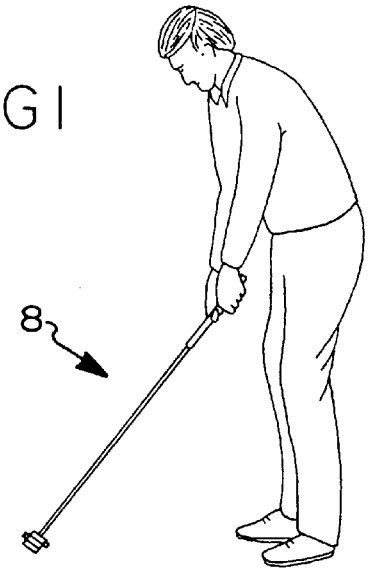
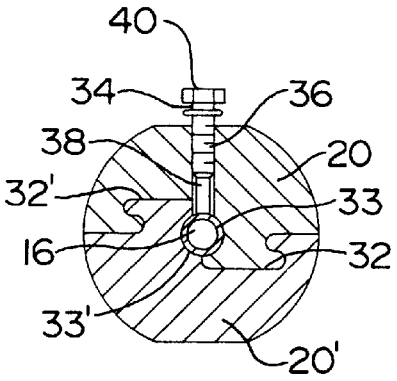
FIG 3
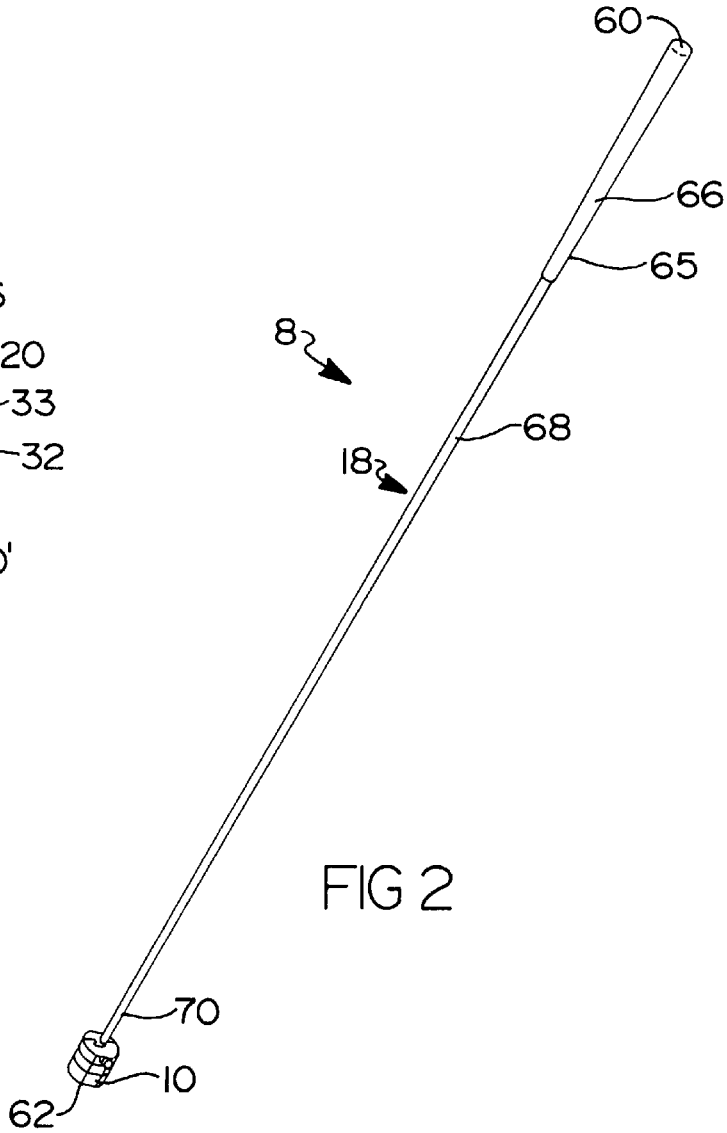
FIG 2

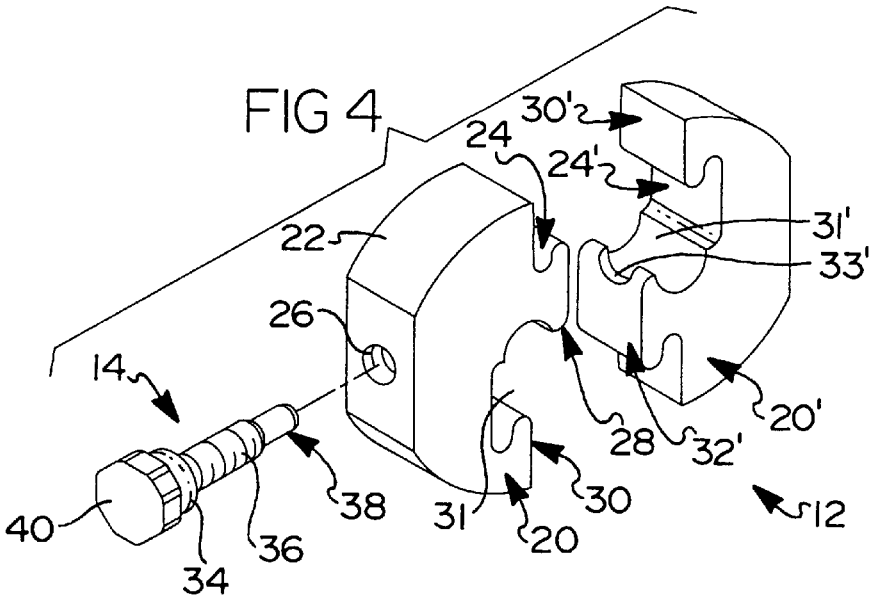
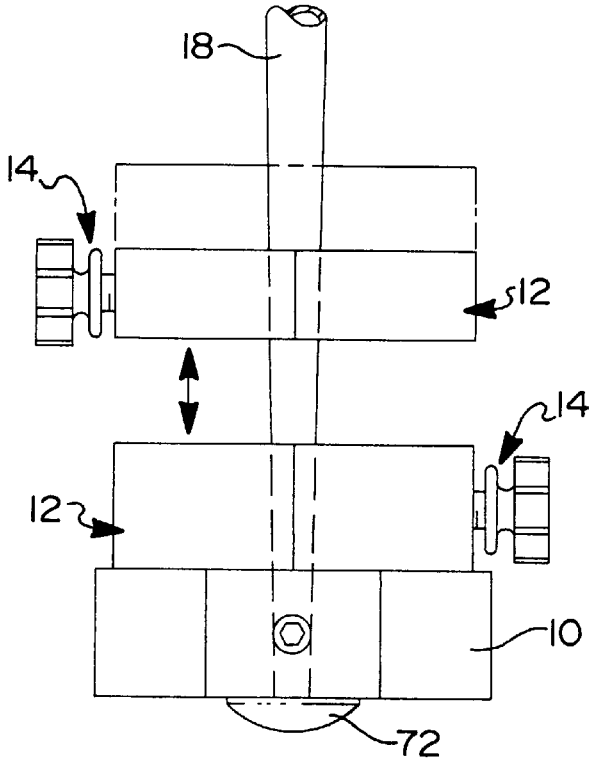
FIG 5

GOLF TRAINING DEVICE

CROSS REFERENCE TO PENDING APPLICATION

This application is a continuation-in-part of co-pending U.S. application Ser. No. 08/685,441, filed Jul. 23, 1996 for Housing and Securing Device, which is a divisional application of Ser. No. 08/312,816 filed Sep. 27, 1994 now issued U.S. Pat. No. 5,538,299, the disclosures of which are incorporated herein by reference.

BACKGROUND OF THE INVENTION

I. Field of the Invention

The present invention relates generally to golf training devices. More particularly, the present invention concerns weighted golf training devices. Even more particularly, the present invention concerns weighted golf-swing training devices.

II. Prior Art

In the above referred to co-pending application and issued patent, there is disclosed a locking device which may be removably secured about a shaft. The device is defined by interdigitated opposingly arranged body portions that are locked together by way of a helically threaded fastener. The body portions cooperate to define a body member having a central aperture formed therethrough which enables the device to be secured to the shaft.

It has now been discovered that the principles embodied in the locking device thereof may be used to provide an improved golf swing training device. It is to this to which the present invention is directed.

SUMMARY OF THE INVENTION

In accordance with a first aspect of the present invention, there is provided a golf-swing training device which, generally, comprises:

(a) a shaft having a first end and a second end, the shaft having a top portion proximate the first end which defines a handle portion or grasping portion, a middle portion, and a bottom portion proximate the second end;

(b) a stopper abutting the second end and having a diameter greater than that of the bottom portion of the shaft; and (c) at least one weight removably affixed to the shaft, the weight comprising:

(1) first and second interdigitating opposedly arranged body portions; and (2) at least one locking member for locking the first and second body portions together and securing the body member to the shaft thereby precluding the slidable movement of the shaft relative to the body member.

At least one of the two body portions of the weight has a threaded channel formed therein so that when the two body portions are interdigitated about the shaft, the resulting body member has a channel drawn from its outer surface to its inner surface.

The locking member, which may be a screw or the like, fits into the channel and functions to secure the two body portions together, while allowing the shaft to slidably move through the central aperture when not engaged therewith.

When fitted together, the threaded screw secures the body member to the shaft in position by pressing the shaft against the inner surface of the body member. The body member is now in a fully locked position. In the fully locked position, the body member is restricted from slidable movement along the bottom portion of the shaft. The body member does not move relative to any portion of the shaft. The body member has a sufficient weight or mass such that in executing a golf swing the centripetal force created thereby forces a proper swing.

The shaft is, preferably, tapered and is fabricated to simulate a golf club such that the top portion is fitted with a conventional grip covering.

In use, one or more weights, of the same, or different mass may be placed about the shaft.

In a second aspect hereof, there is provided a weight of the type hereinabove described which is securable about a golf club shaft and which, thereby, provides a golf swing practice or warm-up weight.

The present invention will be more clearly understood with reference to the accompanying drawings. Throughout the various figures, like reference numerals refer to like parts in which:

BRIEF DESCRIPTION OF THE DRAWINGS

FIG. 1 is an environmental view depicting a preferred embodiment of the golf-swing training device hereof;

FIG. 2 is a perspective view of the training device;

FIG. 3 is a cross-sectional view of the weight member hereof;

FIG. 4 is an exploded, top view of the weight member hereof; and

FIG. 5 is side view of the shaft of the present invention having a plurality of weights mounted thereon.

DETAILED DESCRIPTION OF THE PREFERRED EMBODIMENT

Referring now to the drawings, there is depicted therein a golf-swing training device in accordance herewith and which is, generally, depicted at 8.

The device 8, generally, includes a shaft or rod 18, a stop or stopper 72, and at least one weighted member or weight 10 which removably fits about the shaft 18.

As shown, the weighted member 10 includes a body member 12 and a locking member 14. The body member 12 is, preferably, a cylindrical, substantially, planar member which has a first aperture 16 which is designed to slidably encircle the shaft 18. The body member 12 may be formed of a variety of materials including various dense metals, such as steel, iron, bronze, etc. The weight of the member 10 is a predetermined weight and which ordinarily will vary from about two to ten pounds in weight. Thus, where a plurality of member 10 are mounted about the shaft, the weight of one particular weighted member may differ from another weighted member, as described hereinbelow.

With more particularity and shown in FIGS. 3 and 4, and as described in the co-pending application and in a preferred embodiment hereof, the body member 12 comprises a pair of opposed body portions 20, 20', which are, preferably, substantially identical and opposedly arrayed, and which interdigitate to form the body member 12. Since the two body portions are, usually, identical for purposes of clarity, the description will only reference one of the body portions, the body portion 20.

The body portion 20 has an outer surface 22, an inner surface 24, and a channel 26, drawn between its outer surface 22, and inner surface 24, respectively. The channel 26 is, preferably, a threaded channel.

The inner surface 24 of the body portion 20 has a first interdigitating member or foot 28, and a second interdigitating member or pedestal 30.

Since, in use, the two body portions 20, 20' are opposedly arranged, the first interdigitating member or foot 28 of the body portion 20 interdigitates with the second interdigitating member 30, of the other body portion 20' to form the body member 12.

The first interdigitating member 28 of the body portion 20 includes a flange 32.

When the two opposedly arranged body portions 20, 20' are interlocked, the flange 32, defines a portion of the edge of the first aperture 16 formed through the body member 12. The flange 32, has a semi-circular notch 33, cut into it. The semi-circular notch 33 of the flange 32 communicates and is coaxial with the channel 26 of the opposedly arranged body portion 20.

As shown in FIG. 4, the pedestal 30 extends inwardly from the periphery or perimeter of the surface 22. A U-shaped core or recess is provided rearwardly of the pedestal 30, as shown. The recess has a width slightly larger than that of the opposed foot 28' of the other body member so that it nests therein. Each foot 28 or 28' is disposed or formed interiorly of the respective body portion.

Each body portion 20 and 20' has a shoulder 35, 35' formed above the interior opening above the associated channel 26, or 26'. The opposed foot 28 or 28' seats in the opposed shoulder upon interdigitation with its associated notch, cooperating to "round off" the interior opening, as shown. The interior portion of each foot nests in an opposed recess 31 or 31'. Likewise, the interior portion of each pedestal nests in the cut-out provided rearwardly of each foot, as shown.

A locking member 14 such as a helically threaded fastener or screw 34 or other suitable means for fastening may be projected or threaded through the channel 26 to lock the two body portions together as well as to secure the device 10 to the shaft 18.

Where the channel 26 is threaded, a threaded fastener is used. The helically threaded fastener has a threaded portion 36, a bearing surface 38 and a finger or head portion 40.

The threaded portion 36 of the locking member 14 is helically threaded so as to be received by either of the helically threaded channels 26 of the two substantially identical body portions 20, 20'. Additionally, the bearing surface 38 of the locking member 14 is preferably made of a soft metal or plastic to prevent damage to the shaft 18. The finger or head portion 40 is designed to allow a person to easily grasp and manually turn the fastener 34.

When the body portions 20, 20' are interdigitated and the helically threaded fastener 34 is inserted into one of the helically threaded channels 26, 26' so that the bearing surface 38 of the helically threaded fastener 34 is just short of protruding into the first aperture 16 of the body member 12, the two portions are secured together although the shaft is not secured, since the fastener has a length greater than either channel. This is the semi-locked configuration which allows positioning of the weight on the shaft.

In this configuration, a small section 40 of the helically threaded portion 36 of the helically threaded fastener 34 engages the semi-circular notch 33, 33' of the flange 32, 32' on the first interdigitating member 28 or 28' of the opposedly arranged body portion 20, 20'.

When the bearing surface 38 of the fastener 34 protrudes into the first aperture 16 of the body member 12 and bears against the shaft 18, the two body portions 20, 20' are locked together and the body member 12 is positioned in place relative to the shaft 18.

Referring now to FIGS. 1 and 5, the shaft 18 is depicted as, preferably, comprising a golf club shaft and may be made of any suitable metal, graphite, or composite materials. The shaft 18, about which the body member is slidably and removably positioned, includes a first end 60 and a second end 62. The first end 60 has a greater radius than that of the second end 62. The shaft 18, thus, is downwardly tapered from the first end toward the second end. As with any golf shaft, the shaft 18 includes a top portion 65 proximate the first end, a middle portion, and a bottom portion proximate the second end.

An elastic, leather, or conventional gripping material 66 is applied over the top portion 65 of the shaft thereby aiding the user in gripping and handling the device hereof. The gripping material 66, ordinarily, has harmonious notches and indentures thereon to further aid the user and to provide an aesthetic look, as known to the skilled artisan.

The middle portion 68 may include the conventional lateral indentured grooves positioned downwardly throughout, as is ordinarily encountered with a golf shaft.

The bottom portion 70 is that area of the shaft 18 about which at least one weight member 10 is both slidably and removably positioned. The bottom portion 70 terminates at the second end 62 of the shaft 18. The bottom portion is integral with the middle portion and has a substantially constant radius.

The stopper 72 extends from the second end of the shaft 18 and is co-axial with the longitudinal axis of the shaft 18. Preferably, the stopper 72 has a circular planar base and an obtusely arcuate top. The base abuts against the second end of the shaft 18. The stopper 72 is connected thereto, preferably by welding. The base has a radius greater than the radius of the second end 62. The stopper 72 is affixed to the shaft 18 at the second end 62, and projects outwardly therefrom. The stopper provides a means of further preventing inadvertent disengagement of the weighted member 10 from the shaft 18. The stopper is made of any suitable material, such as metal, graphite, plastic, or composite materials.

As depicted on FIG. 5, a plurality of weighted member 10 may be mounted thereon. The mountable plurality of the weighted member 10 provides to the user the capability of adjusting the mass of the present invention to the desired magnitude.

The present invention is particularly adapted for use in golf training and golf warm-up. The present invention simulates a conventional golf club whereby the user adjusts the present invention to a desired weight by selecting a proper weighted member(s) and mounting it (them) on the shaft. In fabricating the present device, it is contemplated that the combination of the shaft, the stopper, and a seven ounce weighted member provides a combined weight equal to that of a standard driver. However, the weight of the weighted member varies in weight according to the preferences of the user. Thereafter the golfer practices proper golf swing techniques. Additionally, the present invention may be used as a golf practice device to aid the user in warm-up swinging, pre-game stretching activities, and the like. As a warm-up device, the present device is more advantageous than "donuts" in that it does not ride up and down the shaft, thus, obviating the potential of breaking the club at the hosel.

Having, thus, described the present invention, what is claimed is:

1. A golf-swing training device comprising:

(a) an elongated shaft for removably mounting a weight member thereonto, the shaft including a first end and a second end;

(b) a stopper having a radius greater than the radius of the second end and projecting outwardly therefrom and coaxial therewith, the stopper preventing slidable detachment of a weight member from the shaft;

(c) at least one weight member removably mountable to the shaft, the at least one weight member comprising: a body member having a substantially centered aperture, the aperture adapted for securing the member to a golf club shaft, the body member further comprising (i) first and second opposedly-arranged, identical body portions adapted to be freely slidable in a direction parallel to the longitudinal axis of the aperture, each of the first and second body portions having a male pedestal portion, a male foot portion, a U-shaped recess, and an inner surface, wherein each inner surface defines a first female portion for axially slidably receiving the male foot portion of each opposite body portion in an interdigitating relationship and each U-shaped recess of each body portion defines a second female portion for axially slidably receiving the male pedestal portion of each opposite body portion in an interdigitating relationship, the body portions being prevented from radial disengagement by the interdigitation of the two body portions; and (ii) a channel extending radially through the outer periphery of the body member and into the aperture, the channel extending through the inner surface of each body portion and through the interdigitated foot portion of the other body portion thereby defining a notch in the foot portion of the other body member; and a locking member for engaging in the channel when the body portions are assembled onto a golf club shaft, the locking member lockingly engaging the shaft to thereby prevent axial sliding movement of the weighted member relative to the shaft.

2. The device of claim 1, wherein the shaft is a cylindrical tapered shaft.

3. The device of claim 1, wherein the shaft further comprises:

(a) a top portion which extends from the first end, the top portion having a decreasing tapered radius from the first end toward the second end, (b) a middle portion integral with the top portion, the middle portion having a decreasing tapered radius extending toward the second end; and (c) a bottom portion integral with the middle portion and having a constant radius, the at least one weight member being removably mounted onto the bottom portion.

4. The device of claim 1, further comprising a grip material overlaying the top portion.

5. The device of claim 1, which further comprises: a plurality of weight members mounted onto the shaft, each of the weight members comprising the weight member of claim 1.

6. The device of claim 1, wherein the body member is substantially disc shaped.

7. The device of claim 1, wherein the locking member is a threaded fastener.

8. The device of claim 7, wherein the threaded fastener comprises a manually graspable head disposed externally of the channel, the head facilitating manual rotation of the fastener.

* * * * *